US006578336B2

(12) United States Patent
Elliott

(10) Patent No.: US 6,578,336 B2
(45) Date of Patent: Jun. 17, 2003

(54) SHINGLE FOR OPTICALLY SIMULATING A TILED ROOF

(75) Inventor: Bert Whitmore Elliott, Westerville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/161,770

(22) Filed: Jun. 4, 2002

(65) Prior Publication Data

US 2002/0178679 A1 Dec. 5, 2002

Related U.S. Application Data

(62) Division of application No. 09/429,940, filed on Oct. 29, 1999, now Pat. No. 6,421,976.

(51) Int. Cl.[7] ..... E04D 1/00
(52) U.S. Cl. ..... 52/555; 52/557; 52/559
(58) Field of Search ..... 52/559, 557, 554, 52/555

(56) References Cited

U.S. PATENT DOCUMENTS

| | | | |
|---|---|---|---|
| 891,501 | A | 6/1908 | Overbury |
| D48,172 | S | 11/1915 | Dun Lany |
| 1,295,360 | A | 2/1919 | Overbury |
| 1,345,627 | A | 7/1920 | Overbury |
| 1,913,768 | A | 6/1933 | Moone |
| 1,913,836 | A | 6/1933 | Hamlin |
| RE18,919 | E | 8/1933 | Levis |
| 2,199,760 | A | 5/1940 | Schuetz |
| 3,921,358 | A | 11/1975 | Bettoli |
| 4,191,722 | A | 3/1980 | Gould |
| 4,226,070 | A | 10/1980 | Aragon |
| 4,274,243 | A | 6/1981 | Corbin et al. |
| 4,498,267 | A | 2/1985 | Beck |
| 4,717,614 | A | 1/1988 | Bondoc et al. |
| D314,439 | S | 2/1991 | Jenkins et al. |
| D314,628 | S | 2/1991 | Jenkins et al. |
| D317,506 | S | 6/1991 | Jenkins et al. |
| 5,048,255 | A | 9/1991 | Gonzales |
| 5,094,058 | A | 3/1992 | Slocum |
| 5,426,902 | A | 6/1995 | Stahl et al. |
| D376,660 | S | 12/1996 | Hannah et al. |
| 5,660,014 | A | 8/1997 | Stahl et al. |
| 5,666,776 | A | 9/1997 | Weaver et al. |
| D388,195 | S | 12/1997 | Hannah et al. |
| 5,901,517 | A | 5/1999 | Stahl et al. |

FOREIGN PATENT DOCUMENTS

| | | |
|---|---|---|
| DE | 29 50 671 A1 | 7/1980 |
| WO | WO 99/34073 | 12/1997 |
| WO | 99/34073 | 7/1999 |

*Primary Examiner*—Anthony D. Barfield
(74) *Attorney, Agent, or Firm*—Inger H. Eckert; James J. Dottavio

(57) ABSTRACT

A laminated shingle simulates a tiled roof when placed with other similar shingles on a roof deck. The laminated shingle includes an overlay member and an underlay member fixedly attached to each other. The overlay member includes an upper or headlap portion and a lower or exposed butt portion with one or more substantially identically shaped tabs with a cutout between each tab. The lower edge of the tabs may have a curving or negative contour. The tabs may taper in width from the butt edge to the lower edge of the headlap portion. The upper edge of the cutouts may have a generally straight contour or a generally curved contour. The lower edge of the underlay member may have a generally straight contour or a portion of the lower edge may have a generally curving contour. The overlay member and/or underlay member may include a darker shading area to enhance the tile simulating aspect of the shingle. In one embodiment, a plurality of shingles may be placed on a roof deck such that the tabs in the course of shingles are vertically aligned with the tabs in the adjacent course of shingles. Alternatively, the tabs may be vertically aligned with the cutouts in the adjacent course of shingles.

19 Claims, 8 Drawing Sheets

FIG. 1
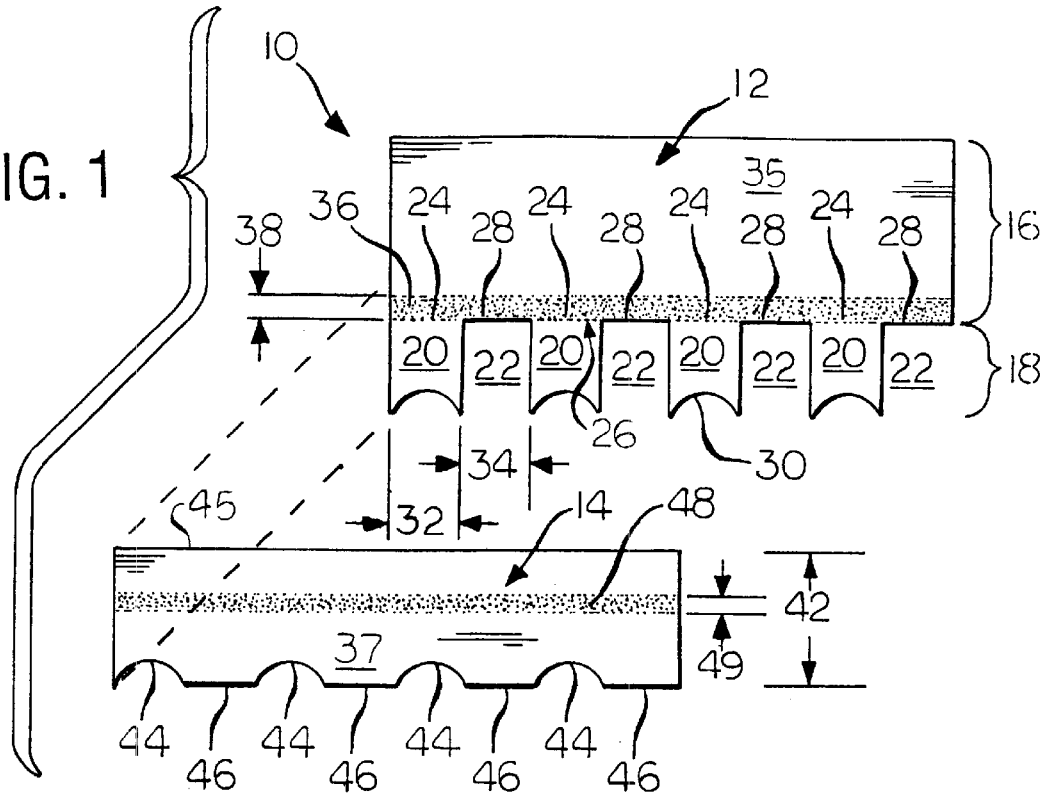
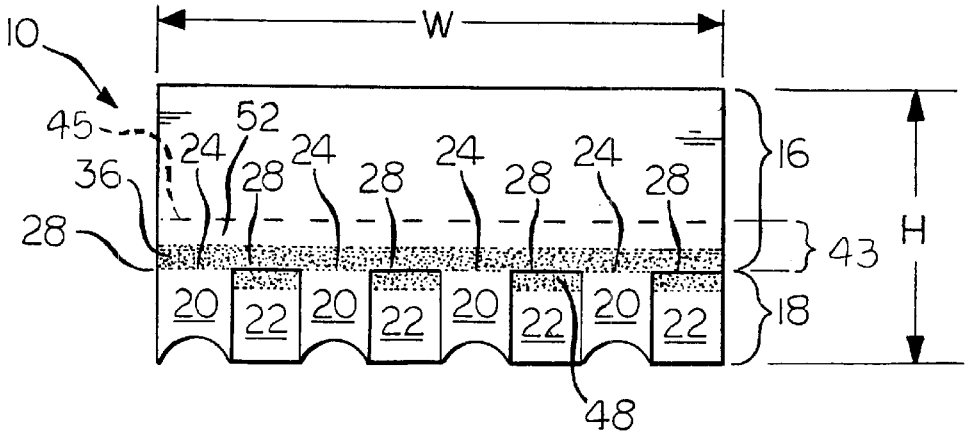
FIG. 2

FIG. 5
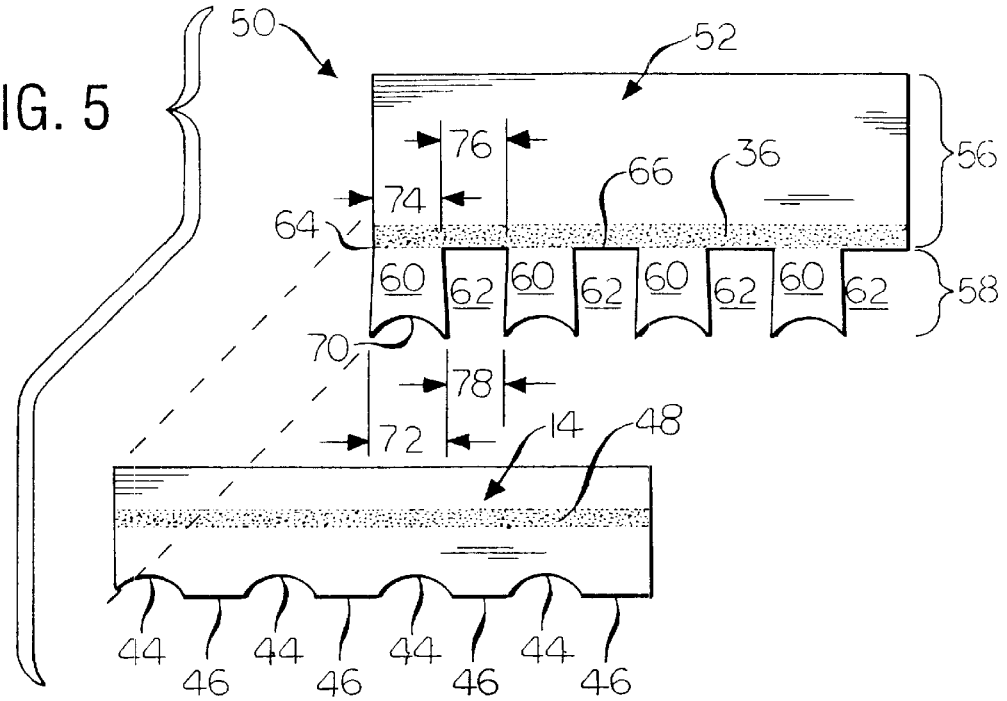
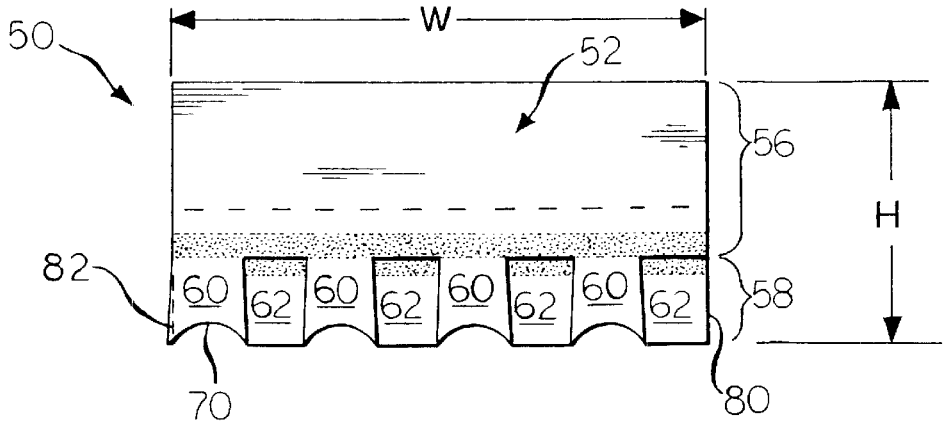
FIG. 6

FIG. 9
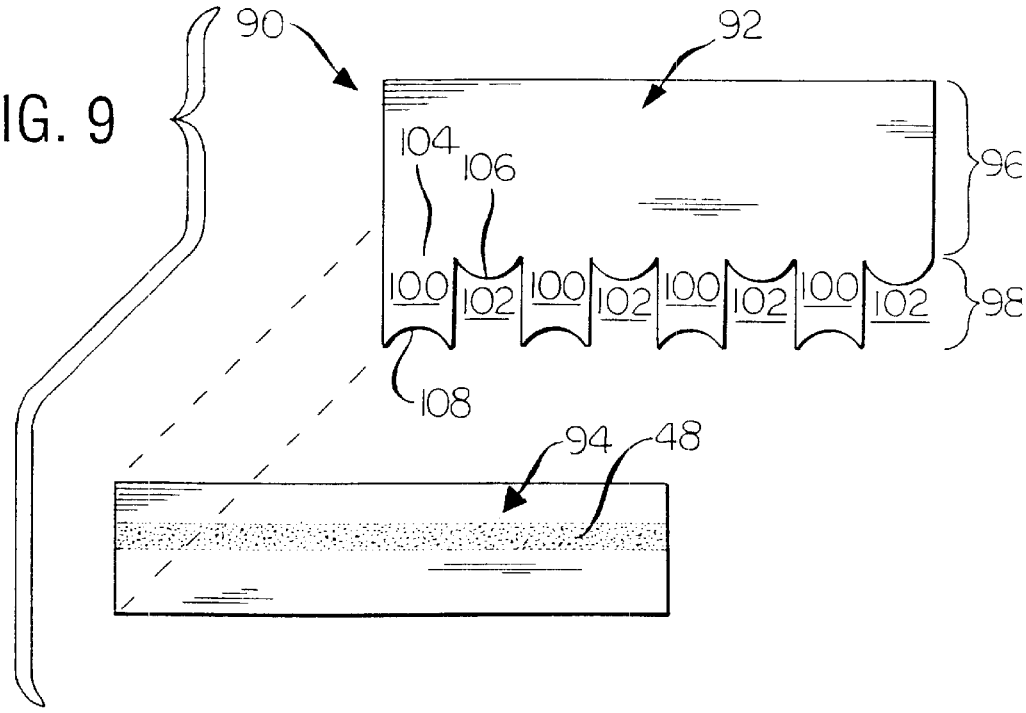
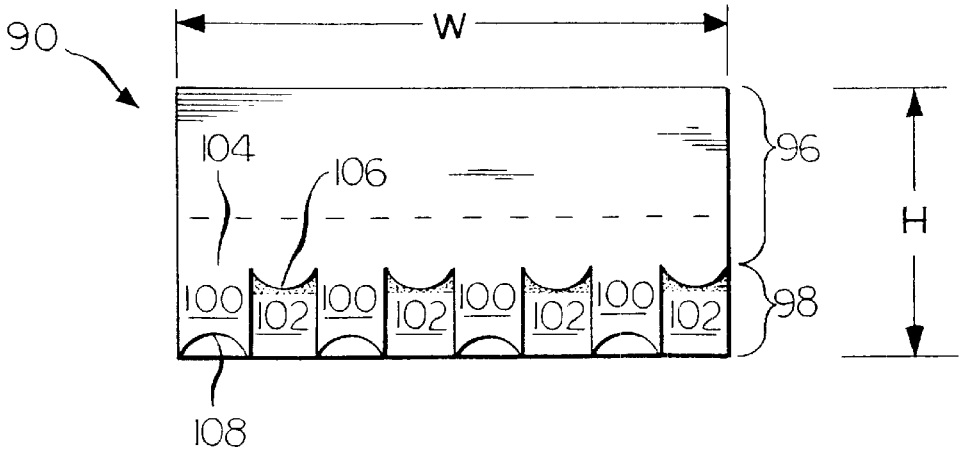
FIG. 10

FIG. 13
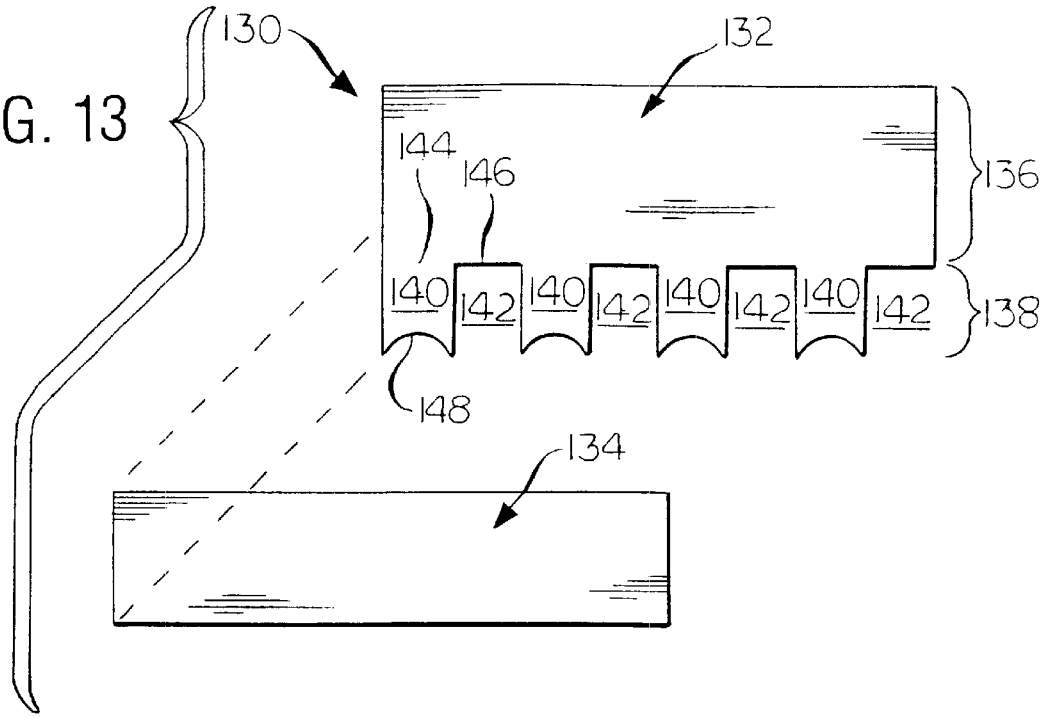
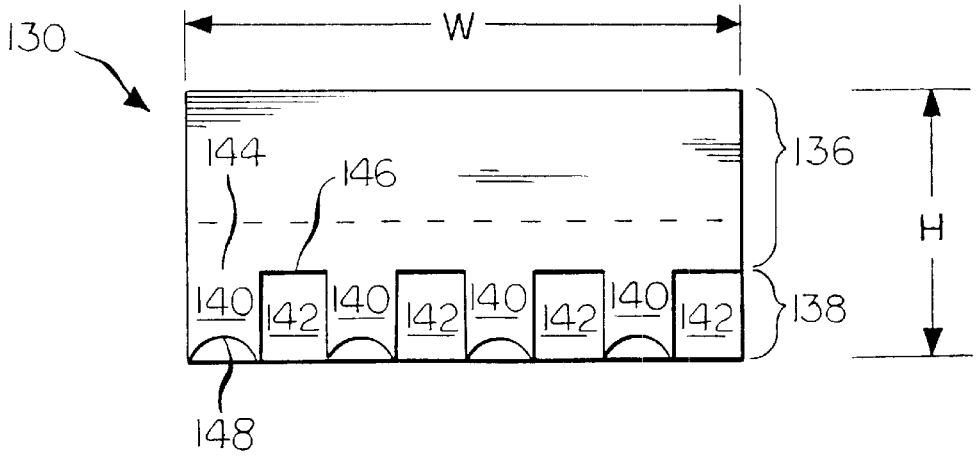
FIG. 14

SHINGLE FOR OPTICALLY SIMULATING A TILED ROOF

CROSS-REFERENCE TO RELATED APPLICATION

This application is a division of application Ser. No. 09/429,940, filed Oct. 29, 1999, now U.S. Pat. No. 6,421, 976, the contents of which are incorporated herein by reference.

TECHNICAL FIELD AND INDUSTRIAL APPLICABILITY OF THE INVENTION

This invention relates in general to a shingle, and in particular, to a laminated roofing shingle including an overlay with various cutouts and an underlay with a shadow line such that the shingle operates to optically simulate the three dimensional ridges and valleys of a tiled roof when laid on a roof.

BACKGROUND OF THE INVENTION

In the past, roofing shingles have had to satisfy two main functions when applied to a roof deck. The first function is to provide a durable, weatherproof covering for the roof deck. Roof shingles, whatever their form, are intended to provide a means of sheltering the structure below the shingles from precipitation and the deleterious effects of sun and wind. Roof shingles installed on the roof deck must perform these protecting functions for a reasonable period of time. The second function is to present an aesthetically pleasing architectural feature which enhances the overall appeal of the structure to which the shingles have been applied. This aesthetic function has been satisfied by providing asphalt shingles with various butt edge contours and surface treatments which operate to simulate more traditional, and in most cases more expensive, forms of roof coverings, such as, thatch, wooden shakes, slates, and even tiles of various forms.

However, none of the prior art shingles have been able to combine the protective and aesthetic functions while providing a laminated, asphalt shingle that simulates a tile roof on a practical production scale.

SUMMARY OF THE INVENTION

This invention relates to a laminated shingle. The laminated shingle comprises an overlay member having a front surface, a rear surface, an upper portion and a lower portion. The upper portion includes a layer of granules on the front surface forming a first, darker shading area. The lower portion includes one or more tabs separated by cutouts. Each tab extends from a lower boundary of the upper portion to a lower edge. The lower edge has a generally curved contour. An upper edge of each cutout has a generally straight contour. The laminated shingle further comprises an underlay member having a front surface. The front surface is fixedly attached to the rear surface of the overlay member. The underlay member includes a layer of granules on the front surface forming a second, darker shading area. The underlay member further includes a lower edge. A portion of the lower edge has a generally curved contour. Each tab of the overlay member covers the second, darker shading area of the underlay member.

In another aspect of the invention, a laminated shingle comprises an overlay member having a front surface, a rear surface, an upper portion and a lower portion. The lower portion includes one or more tabs separated by cutouts. Each tab extends from a lower boundary of the upper portion to a lower edge. The lower edge has a generally curved contour. An upper edge of each cutout has a generally curved contour. The laminated shingle further comprises an underlay member having a front surface. The front surface is fixedly attached to the rear surface of the overlay member. The underlay member includes a layer of granules on the front surface forming a darker shading area. The underlay member further includes a lower edge having a generally straight contour. Each tab covers the darker shading area of the underlay member to optically simulate the three dimensional ridges and valleys of a tiled roof when the underlay member is fixedly attached to the overlay member.

In yet another aspect of the invention, a laminated shingle comprises an overlay member having a front surface, a rear surface, an upper portion and a lower portion. The lower portion includes one or more tabs separated by cutouts. Each tab extends from a lower boundary of the upper portion to a lower edge. The lower edge has a generally curved contour. An upper edge of each cutout has a generally straight contour. The laminated shingle further comprises an underlay member having a front surface. The front surface is fixedly attached to the rear surface of the overlay member. The underlay member includes a lower edge having a generally straight contour.

In another aspect of the invention, a composite laminated shingle comprises an overlay member having front and rear surfaces. The overlay member includes a headlap portion and a butt portion. The headlap portion includes a lower boundary portion of a generally straight contour. The butt portion includes a plurality of tabs separated by cutouts. Each tab extends in length from the lower boundary of the headlap portion to a lower edge to define a butt edge of the shingle. The lower edge of each tab has a generally curved contour. The shingle further comprises an underlay member having a front surface fixedly attached to the rear surface of the overlay member. The underlay member includes a lower edge, a portion of the lower edge having a generally curved contour corresponding to the lower edge of each tab and exposed portions extending between the tabs of the overlay member in the cutouts that separate the tabs. A lower edge of the exposed portions defines a portion of the butt edge of the shingle having a generally straight contour. The shingle operates to optically simulate the three dimensional ridges and valleys of a tiled roof when laid on a roof with other substantially identically shaped shingles in overlapping longitudinal courses in a predetermined assembly in which one of the tabs and cutouts of the identically shaped shingles in each course are vertically aligned with each other.

In yet another aspect of the invention, a roof covering includes a plurality of successive generally horizontal courses of laminated shingles. The shingles in each course are laid in a side-by-side relationship and horizontally offset from the shingles in adjacent courses. Each laminated shingle comprises an overlay member having front and rear surfaces. The overlay member includes a headlap portion and a butt portion. The headlap portion includes a lower boundary portion of a generally straight contour. The butt portion includes a plurality of tabs separated by cutouts. Each tab extends in length from the lower boundary of the headlap portion to a lower edge to define a butt edge of the shingle. The lower edge of each tab has a generally curved contour. The shingle further comprises an underlay member having a front surface fixedly attached to the rear surface of the overlay member. The underlay includes a lower edge. A portion of the lower edge has a generally curved contour corresponding to the lower edge of each tab, and exposed portions extending between the tabs of the overlay member in the cutouts that separate the tabs. A lower edge of the exposed portions defining a portion of the butt edge of the shingle having a generally straight contour. The shingle operates to optically simulate the three dimensional ridges and valleys of a tiled roof when laid on a roof with other substantially identically shaped shingles in overlapping longitudinal courses in a predetermined assembly in which one of the tabs and cutouts of the identically shaped shingles in each course are vertically aligned with each other.

Various objects and advantages of this invention will become apparent to those skilled in the art from the following detailed description of the preferred embodiment, when read in light of the accompanying drawings.

BRIEF DESCRIPTION OF THE DRAWINGS

FIG. 1 is an exploded view of a shingle for optically simulating a tiled roof according to a first preferred embodiment of the invention;

FIG. 2 is a top planar view of the completed shingle of FIG. 1;

FIG. 5 is an exploded view of a shingle for optically simulating a tiled roof according to a second preferred embodiment of the invention;

FIG. 6 is a top planar view of the completed shingle of FIG. 5;

FIG. 9 is an exploded view of a shingle for optically simulating a tiled roof according to a third preferred embodiment of the invention;

FIG. 10 is a top planar view of the completed shingle of FIG. 9;

FIG. 13 is an exploded view of a shingle for optically simulating a tiled roof according to a fourth preferred embodiment of the invention;

FIG. 14 is a top planar view of the completed shingle of FIG. 13;

DETAILED DESCRIPTION AND PREFERRED EMBODIMENTS OF THE INVENTION

Figure 3:
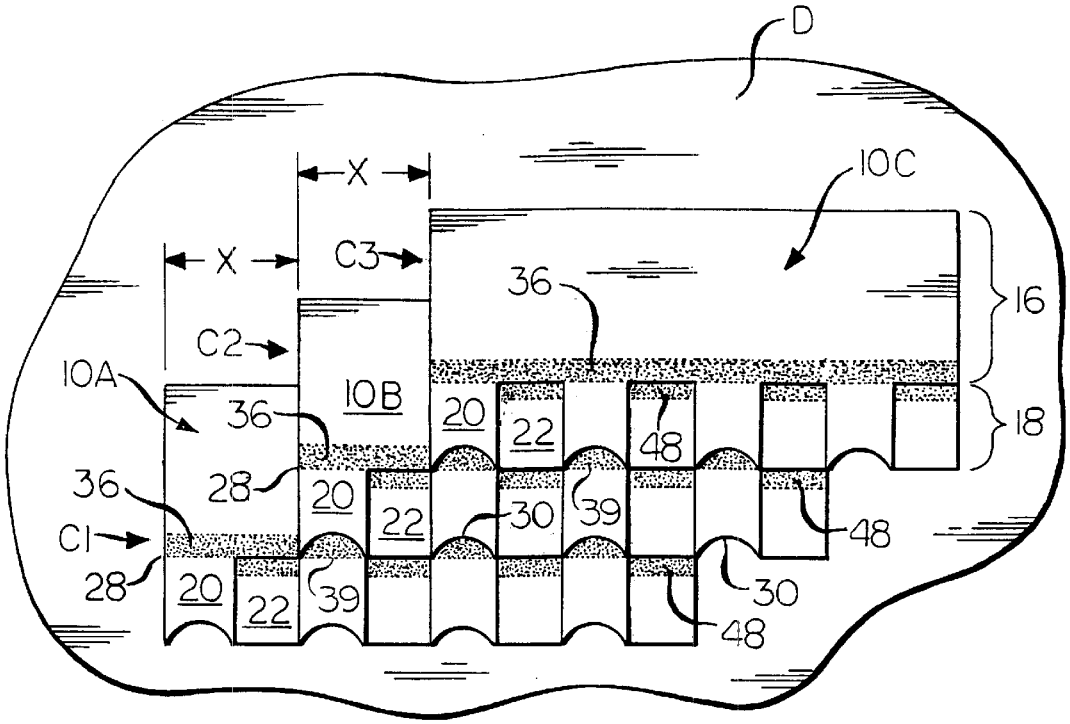
FIG. 3 is a top planar view of a portion of a roof deck covered with the shingles of FIG. 1.

Referring now to the drawings, there is illustrated in FIGS. 1–4 a shingle, shown generally at 10, according to a first preferred embodiment of the invention. Referring now to FIGS. 1 and 2, the shingle 10 is of a type of roofing shingle generally known as a laminated type shingle consisting of an overlay member 12 and an underlay member 14. The overlay and underlay members 12, 14 are preferably constructed of a suitable mat of fiberglass or other construction that is permeated with a preferably asphaltic substance of a type well-known in the art. Typically, a plurality of granules are dispersed over the front surface and are held by the adhesive characteristics of the asphaltic substance permeating the front surface. It should be appreciated that the invention is not limited by the material composition of the overlay and underlay members 12, 14. For example, the overlay and underlay members 12, 14 may comprise a laminar felted material comprising organic or inorganic fibers, or a mixture of both, that are held together with a binding agent. The fibers may be subsequently coated, saturated, or otherwise impregnated with an asphaltic bituminous material according to processes well known in the roofing industry.

The overlay member 12 includes a headlap or upper portion 16 and an exposed butt or lower portion 18. The lower portion 18 includes one or more tabs 20 which are separated from one another by one or more cutouts 22. An upper edge 24 of each tab 20 is substantially defined by and corresponds to a lower boundary 26 of the upper portion 16 of the overlay member 12. An upper edge 28 of each cutout 22 also defines a portion of the lower boundary 26 of the upper portion 16. In the first preferred embodiment, a lower edge 30 of the tab 20 has a generally concave or negatively curving contour, and the upper edge 28 of each cutout 22 has a generally straight contour.

In the first preferred embodiment, the width 32 of the lower edge 30 of each tab 20 is approximately equal to the width 34 of the upper edge of each tab 20. Thus, each tab 20 has generally straight, parallel sides extending from the lower edge 30 to the lower boundary 26 of the upper portion 16. Similarly, each cutout 22 has generally straight, parallel side extending from the lower edge to the lower boundary 26 of the upper portion 16. Preferably, the width 32 of each tab 20 and the width 34 of each cutout 22 are substantially the same magnitude.

In the first preferred embodiment, the upper portion 16 of the overlay member 12 includes a layer of granules on the front surface 35 forming a darker shading area 36 adjacent the lower boundary 26 of the overlay member 12. The darker shading area 36 preferably extends along the lower boundary 26 in a generally straight line to provide the roofer a guide in applying the shingles in a straight line, one next to the other, and in applying successive courses, one over the other. The height 38 of the darker shading area 36 is preferably in the range between about 0.5 inches to 2.0 inches, and more preferably about 1.0 inches. However, it should be appreciated that the height 38 of the darker shading area 36 can be varied depending on the dimensions of the shingle 10 and the desired optical effect when similar shingles are laid on the roof deck. Preferably, the width of the darker shading area 36 generally corresponds to the width, W, of the overlay member 12. Alternatively, the width of the darker shading area 36 may be interrupted intermittently along the width, W, of the overlay member 12.

In the first preferred embodiment, the upper portion 16 of the overlay member 12 includes a layer of granules on a front surface 35 forming a darker shading area 36 adjacent the lower boundary 26 of the overlay member 12. The darker shading area 36 preferably extends along the lower boundary 26 in a generally straight line to provide the roofer a guide in applying the shingles in a straight line, one next to the other, and in applying successive courses, one over the other. The height 38 of the darker shading area 36 is preferably in the range between about 0.5 inches to 2.0 inches, and more preferably about 1.0 inches. However, it should be appreciated that the height 38 of the darker shading area 36 can be varied depending on the dimensions of the shingle 10 and the desired optical effect when similar shingles are laid on the roof deck. Preferably, the width of the darker shading area 36 generally corresponds to the width, W, of the overlay member 12. Alternatively, the width of the darker shading area 36 may be interrupted intermittently along the width, W, of the overlay member 12.

In a manner similar to the darker shaded area 36 provided on the overlay member 12, the underlay member 14 includes a layer of granules on a front surface 37 forming a darker shading area 48. The darker shading area 48 preferably extends the entire width, W, of the underlay member 14 in a generally straight line to provide a guide when fixedly attaching the overlay and underlay members 12, 14 to each other. Alternatively, the width of the darker shading area 48 may be interrupted intermittently along the width, W, of the underlay member 14. The height 49 of the darker shading area 48 is preferably in the range between about 0.5 inches to 2.0 inches, and more preferably about 1.0 inches. However, it should be appreciated that the height 49 of the darker shading area 48 can be varied depending on the dimensions of the shingle 10 and the desired optical effect when similar shingles are laid on the roof deck.

Referring now to FIG. 2, a rear surface 41 (FIG. 4) of the overlay member 12 and the front surface 37 of the underlay member 14 are fixedly attached to each other to form the laminated shingle 10. This can be accomplished by using adhesive materials applied to the surfaces 37, 41 between each tab 20 and the corresponding underlying portion of the underlay member 14. Additionally, it may be desirable to provide a common bonding area 43 which is the area of overlap between an upper edge 45 of the underlay member 14 and the lower boundary area 26 of the overlay member 16. Preferably, the common bonding area 43 extends substantially the entire width, W, of the shingle 10 above the upper edge of each of the cutouts 22 and approximate to the lower boundary 26 of the overlay member 16. The width of the common bonding area 43 depends on the height of the tabs 20 and cutouts 22 with respect to the height 42 of the underlay member 14. In addition, the width of the common bonding area 43 depends on the height, H, of the completed shingle 10. Preferably, the common bonding area 43 has a width in the range of about 1 to 2 inches, and more preferably about 1.5 inches (3.8 cm).

The completed shingle 10 is of a generally rectangular shape having a width, W, of approximately 40 inches (101.6 cm) and an overall height, H, of approximately 17.0 inches (43.2 cm). The overall height, H, is divided between the upper or headlap portion 16 having a dimension of approximately 9.5 inches (24.1 cm) and the lower or exposed butt portion 18 having a dimension of approximately 7.5 inches (19.1 cm) when arranged with other similar shingles on a roof deck as described below. It should be appreciated that the invention is not limited by the dimensions of the shingle 10, and that the invention can be practiced with any dimensions. For example, the width, W, may be approximately 36 inches (91.4 cm) and the height, H, may be approximately 24.0 inches (61.0 cm).

One feature of the first preferred embodiment of the invention is the overlapping cooperation of the curved contour of the lower edge 30 of each tab 20 with the straight contour of the upper edge of each cutout 22, in combination with the darker shading areas 36, 48, to optically simulate the three dimensional ridges and valleys of a tiled roof when laid on a roof with other shingles of similar shape. As seen in FIG. 2, the darker shading area 48 of the underlay member 14 is covered by each tab 20 of the overlay member 12. In other words, only each cutout 22 of the overlay member 14 exposes the darker shading area 48 of the underlay member 14.

Figure 4:
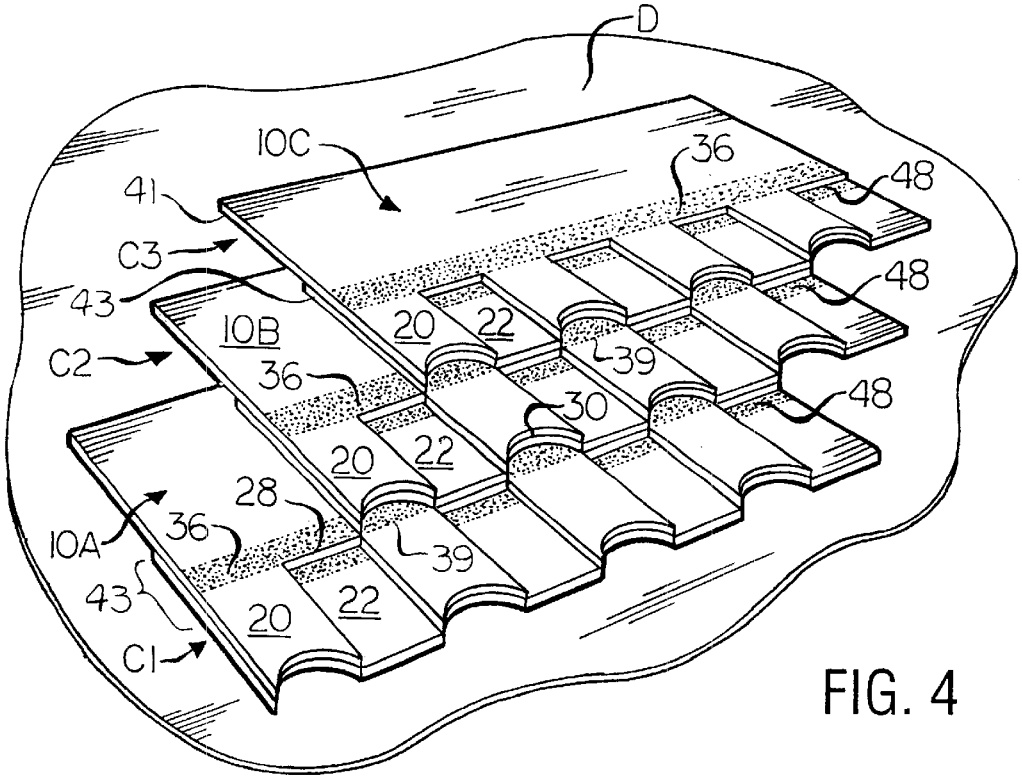
FIG. 4 is a perspective view of a portion of a roof deck covered with the shingles of FIG. 1.

Referring now to FIGS. 3 and 4, there is illustrated a fragmentary roof deck, D, with a roof covering made with a plurality of roofing shingles 10 according to the first preferred embodiment of the invention. In general, the roofing shingles 10 are arranged in a series of horizontal courses of which a portion of three such courses C1, C2 and C3 are shown. Shingle 10A in course C1 is shown being overlapped by shingle 10B in course C2. Likewise, shingle 10B in course C2 is shown being overlapped by shingle 10C in course C3. The extreme left-most and right-most edges of shingles 10A, 10B, 10C are shown without the shingles which would normally precede and succeed these shingles in each of the courses, C1, C2, C3. This is done in order to more fully illustrate the desired placement of each shingle in each overlapping course. Thus, it is understood that the roof deck, D, in the finished tile simulating roof covering would be substantially completely covered by a plurality of substantially identically shaped shingles 10A, 10B, and 10C.

One feature of the invention is the desirable sequence in which the shingles making up each overlapping course are laid. Preferably, the shingles 10A making up course C1 would be laid for a substantial horizontal distance along deck, D. Then, shingles 10B making up course C2 are laid in an overlapping fashion such that the headlap portion 16 of the shingles 10A making up course C1 are covered by shingles 10B in course C2. Also, it should be noted that the identically shaped shingles in overlapping longitudinal courses (for example, C2 and C3) are longitudinally offset by a predetermined distance, X. This longitudinal offset serves to prevent the joint which is formed between each adjacent shingle in each course from corresponding to the joint between the shingles in the subsequent overlapping course. If this were not done, water from precipitation may inevitably penetrate these joints and find its way to a potentially damaging location in contact with the underlying roof deck, D. In offsetting these joints, there is no direct path for such water between each shingle.

In addition to preventing the penetration of water from precipitation, offsetting shingles in subsequent overlapping courses provides an overall aesthetic effect. In the first preferred embodiment, the distance, X, is equal to approximately one fourth of the overall width, W, of each shingle 10A, 10B, and 10C. The choice of this distance, X, vertically aligns each tab 20 of the shingles 10A, 10B, and 10C in each longitudinal course, C1, C2 and C3 up the roof deck, D. Because each tab 20 and each cutout 22 are substantially identical in shape and dimension, the choice of the distance, X, also vertically aligns each cutout 22 of the shingle in each longitudinal course, C1, C2 and C3 up the roof deck, D.

The use of the darker shading areas 36, 48 becomes apparent with reference to FIGS. 3 and 4. As can be readily seen, each shingle in each subsequent overlapping course is positioned so that not only are each tab 20 and each cutout 22 vertically aligned with a tab and cutout, respectively of a shingle in the next lower or previously laid course of shingles, but also the lower edge 30 of each tab 20 in subsequent overlapping courses is positioned to substantially correspond to the upper edge 28 of each cutout 22 (and the lower boundary 26 of each shingle). Positioning each shingle in each subsequent overlapping course in this manner exposes a portion 39 of the darker shading area 36 of the underlying shingle. More specifically, the portion 39 of the darker shading area 36 of shingle 10A in course C1 is exposed by the lower edge 30 of the shingle 10B in course C2. Because the lower edge 30 has a curved or negatively curving contour, the portion 39 of the darker shading area 36 that is exposed by the shingle 10B will also have a curved or negatively curving contour, enhancing the tile simulating aspect of the invention. This feature, in combination with each cutout 22 exposing the darker shading areas 48 as described above, produces an alternating pattern of generally rectangular shaped darker shading areas 48 and curved shaped darker shading areas 39 along each longitudinal course C1, C2 and C3, further enhancing the tile simulating aspect of the invention.

In addition to the dark shadow areas 36, 48 enhancing the tile simulating aspect of the invention, the positioning of the lower edge 30 of each tab 20 to subsequently correspond to the upper edge 28 of each cutout 22 results in an apparent edge thickness at the lower edge 30 of each tab 20 to have a thickness of twice the tab 20 of the underlying shingle. More specifically, the lower edge 30 of each tab 20 in the shingle 10B of the course C2 has an apparent edge thickness of twice each tab 20 in the shingle 10A of the course C1. Further, each tab 20 in the shingles 10A, 10B, and 10C are twice as thick as the underlay member 14 exposed by each cutout 22. This feature, combined with the double thick portion of the lower edge 30 of each tab 20, provides a heightened shadow effect, further enhancing the tile simulating aspect of the invention.

As described above, the vertical alignment of each tab 20 and each cutout 20 in the shingles 10A, 10B, and 10C emphasizes the vertical components of the pattern which simulate the ridges and valleys (also known as caps and water courses) of a tiled roof. As each shingle is made up of four sets of one tab 20 and one cutout 22, the offset distance, X, of one fourth the overall width, W, (or the distance equal to one tab and one cutout) of each shingle not only results in maintaining the vertical alignment of tabs and cutouts, but also prevents water leakage through a roof deck covered with such shingles. However, it should be understood that the invention is not limited by the number of tabs and cutouts, and that the invention can be practiced with any number of tabs and cutouts forming the shingle. For example, the shingle could have as few as two tabs and two cutouts, or as many as six tabs and six cutouts, or more, without departing from the invention.

FIGS. 5 through 8 illustrate a shingle 50 according to a second preferred embodiment of the invention. The shingle 50 is in many aspects substantially identical to the shingle 10. More specifically, the shingle 50 is made up of an overlay member 52 and an underlay member 14 that is identical to the underlay 14 shown in FIG. 1. The overlay member 52 is also substantially identical to the previously described overlay member 12 and includes a headlap or upper portion 56 and an exposed butt or lower portion 58. The lower portion 58 includes one or more tabs 60 which are separated from one another by one or more cutouts 62. An upper edge 64 of each tab 60 is substantially defined by and corresponds to a lower boundary of the upper portion 56 of the overlay member 52. An upper edge 66 of each cutout 62 also defines a portion of the lower boundary of the upper portion 56 of the overlay member 52. A lower edge 70 of the tab 60 has a generally concave or negatively curving contour, and the upper edge 66 of each cutout 62 has a generally straight contour.

However, the overlay member 52 of the shingle 50 includes some distinctions when compared to the overlay member 12 of the shingle 10 of the first preferred embodiment of the invention. One distinction is that the width 72 of the lower edge 70 of each tab 60 is larger than the width 74 of the upper edge 64 of each tab 60, unlike the first preferred embodiment of the invention. As a result, each tab 60 tapers from the lower edge 70 along generally straight sides to its narrowest dimension at the upper edge 64 adjacent the lower boundary of the upper portion 56 of the overlay member 52. Oppositely, the width 76 of the upper edge 66 of each cutout 62 is larger than the width 78 of the lower edge of each cutout 62. Preferably, the narrowest dimension of each tab 60 and each cutout 62 (dimensions 74 and 78, respectively) are substantially the same magnitude. Similarly, the widest dimension of each tab 60 and each cutout 62 (dimensions 72 and 76, respectively) are substantially the same magnitude. The tapered tabs and cutouts can be made by modifying the cutout cylinders that cut the shingles into the overlay members. The cutting arrangement could provide that the cutouts and tabs of one shingle would be complementary to the cutouts and tabs of another shingle.

As best seen in FIG. 6, the right-most cutout 62 differs along its right-most edge 80 from being exactly identical to the shape and symmetry of the other cutouts 62 in the shingle 50. The reason for this can be seen when the right-most edge is positioned adjacent to the left-most edge of the just subsequent shingle 50 in each course of a covered roof deck, and in particular to an overlap portion 82 of the left-most tab 60. When positioned adjacent to the just previous shingle, the overlap portion 82 of the subsequent shingle overlaps the right-most edge 80 of the just previous shingle. Such overlapping cooperation not only results in the right-most cutouts 62 of each shingle having identical shape (i.e., tapered) and symmetry with other cutouts 62, but also provides a more waterproof roof deck covering.

Figure 7:
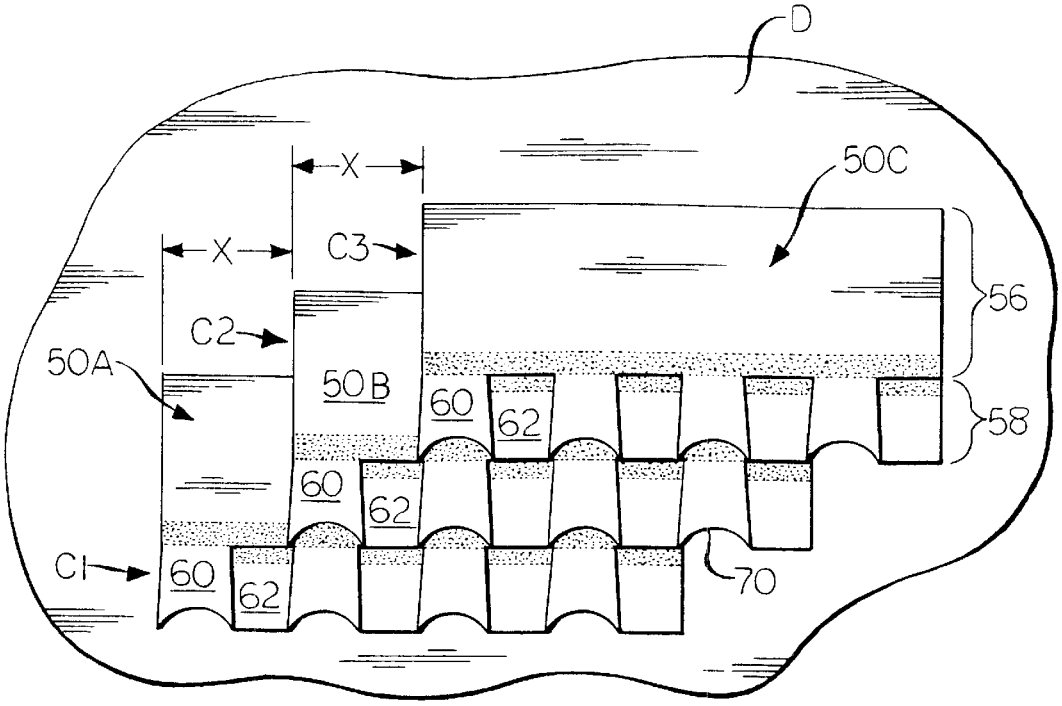
FIG. 7 is a top planar view of a portion of a roof deck covered with the shingles of FIG. 5.
Figure 8:
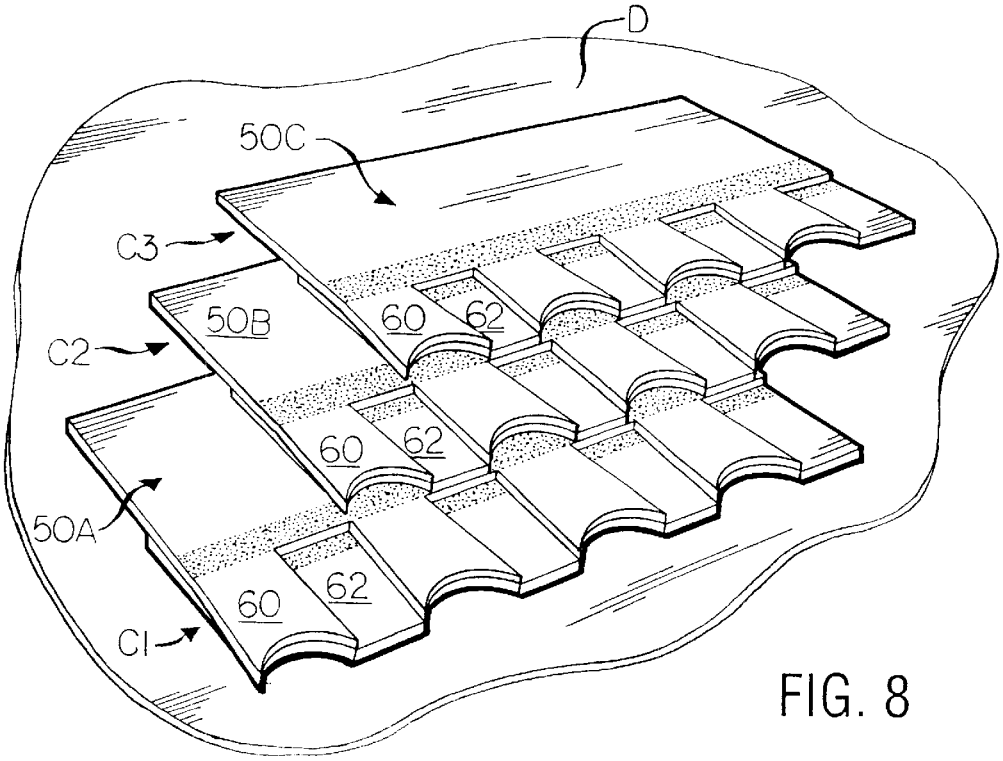
FIG. 8 is a perspective view of a portion of a roof deck covered with the shingles of FIG. 5.

Referring now to FIGS. 7 and 8, the distinctions in the overlay member 52 provide for a different optical simulating effect when compared to the first preferred embodiment of the invention. In particular, the tapering of each tab 60 and each cutout 62 provides an increased three-dimensional optical effect, further enhancing the tile simulating aspect of the invention when compared to the earlier preferred embodiments of the invention.

FIGS. 9 through 12 illustrate a shingle 90 according to a third preferred embodiment of the invention. The shingle 90 is in many aspects substantially identical to the shingles 10 and 50. For example, the shingle 90 is made up of an overlay member 92 and an underlay member 94 substantially identical to the previously described overlay members 12, 52 and underlay members 14.

The overlay member 92 includes a headlap or upper portion 96 and an exposed butt or lower portion 98. The lower portion 98 includes one or more tabs 100 which are separated from one another by one or more cutouts 102. An upper edge 104 of each tab 100 is substantially defined by and corresponds to a lower boundary of the upper portion 96 of the overlay member 92. An upper edge 106 of each cutout 102 also defines a portion of the lower boundary of the upper portion 96 of the overlay member 92. A lower edge 108 of the tab 100 has a generally concave or negatively curving contour.

However, the overlay member 92 includes some distinctions when compared to the overlay members 12, 52 of the first and second preferred embodiments of the invention. One distinction is that the upper edge 106 of each cutout 102 of the overlay member 92 has a generally convex or positively curving contour, rather than a generally straight contour as in the first and second preferred embodiments. Another distinction is that the overlay member 92 does not include the dark shadow area 36 as in the first and second preferred embodiments. Those skilled in the art will appreciate that a further embodiment includes a similar shading effect to that shown in the embodiment illustrated in FIGS. 1–4, by providing a dark shadow on the underlay 94 in the area corresponding to the lower edge 108 of the tab 100.

The underlay member 94 also includes some distinctions when compared to the underlay members 14 of the first and second preferred embodiments of the invention. One distinction is that the underlay member 94 has a generally rectangular shape in which the lower edge has a generally straight contour, rather than including one or more lower edges 44 having a generally concave or negative curving contour, as in the first and second preferred embodiments.

Figure 11:
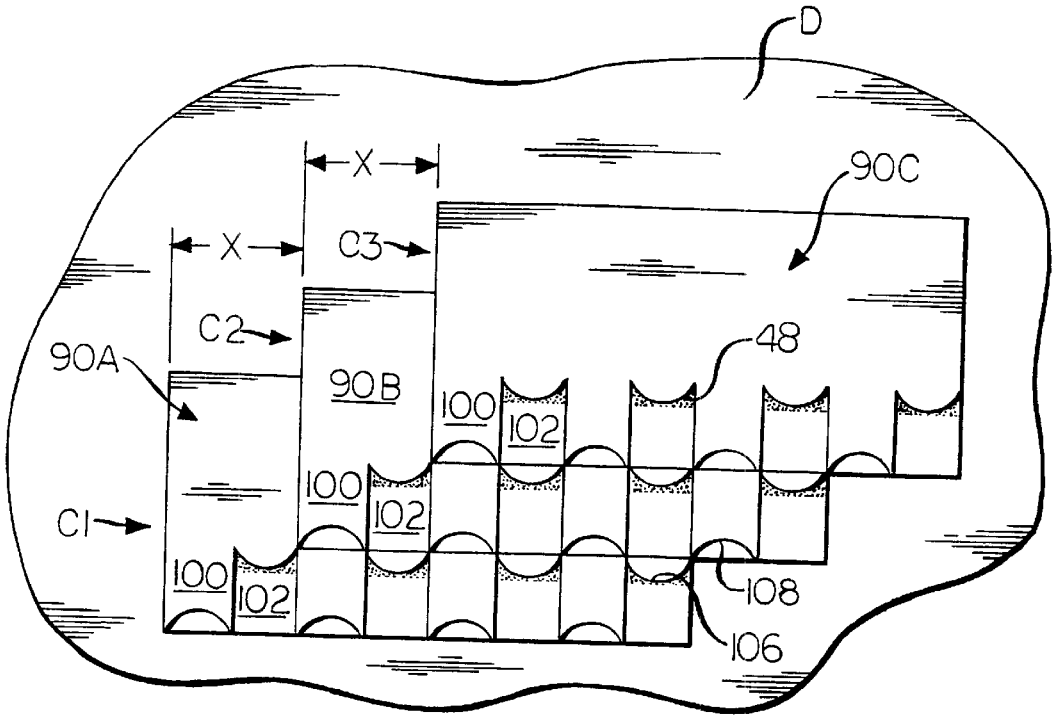
FIG. 11 is a top planar view of a portion of a roof deck covered with the shingles of FIG. 9.
Figure 12:
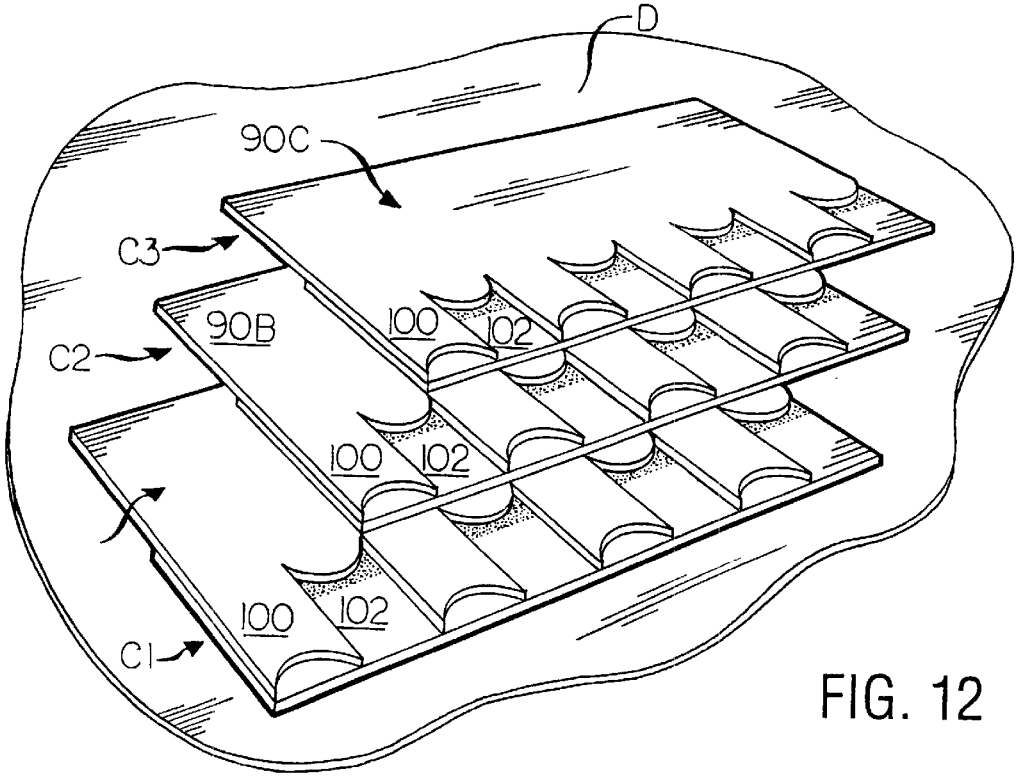
FIG. 12 is a perspective view of a portion of a roof deck covered with the shingles of FIG. 9.

Referring now to FIGS. 11 and 12, these distinctions in the overlay member 92 and the underlay member 94 of the shingle 90 provide for a different simulating tile effect when compared to the earlier preferred embodiments of the invention. In particular, the upper edge 106 of each cutout 102 and the lower edge 108 of each tab 100 provide for a serpentine shaped continuous contour. Further, the dark shadow area 48 of the underlay member 94, in combination with the convex or positively curving contour of the upper edge 106 of each cutout 102, enhances the shadowing effect of the shingle 90. In addition, each tab 100 is twice as thick as each cutout 102, further enhancing the shadowing effect of the shingle 90.

FIGS. 13 through 16 illustrate a shingle 130 according to a fourth preferred embodiment of the invention. The shingle 130 is in many aspects substantially identical to the shingles 10, 50 and 90. In particular, the shingle 130 is made up of an overlay member 132 and an underlay member 134 substantially identical to the previously described overlay members 12, 52, 92 and underlay members 14 and 94. The overlay member 132 includes a headlap or upper portion 136 and an exposed butt or lower portion 138. The lower portion 138 includes one or more tabs 140 which are separated by one another by one or more cutouts 142. An upper edge 144 of each tab 140 is substantially defined by and corresponds to a lower boundary of the upper portion 136 of the overlay member 132. An upper edge 146 of each cutout 142 also defines a portion of the lower boundary of the upper portion 136 of the overlay member 132. A lower edge 148 of each tab 140 has a generally concave or negatively curving contour. The upper edge 146 of each cutout 142 has a generally straight contour. Thus, the overlay member 132 is substantially identical to the overlay member 12, except that the overlay member 152 does not include a darker shading area 36.

The underlay member 134 is generally rectangular in shape and is substantially identical to the underlay member 94, except that the overlay member 134 does not include a darker shading area 48 as in the earlier preferred embodiments. Those skilled in the art will appreciate that a further embodiment includes a similar shading effect to that shown in the embodiment illustrated in FIGS. 1–4, by providing a dark shadow on the underlay 134 in the area corresponding to the lower edge 148 of the tab 140.

Figure 15:
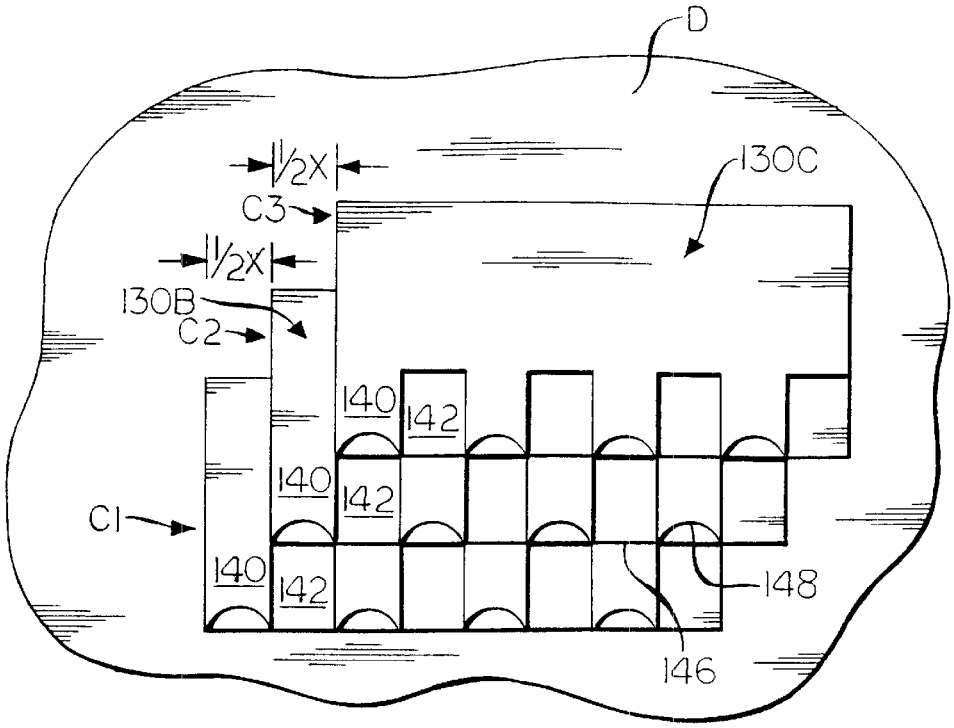
FIG. 15 is a top planar view of a portion of a roof deck covered with the shingles of FIG. 13.
Figure 16:
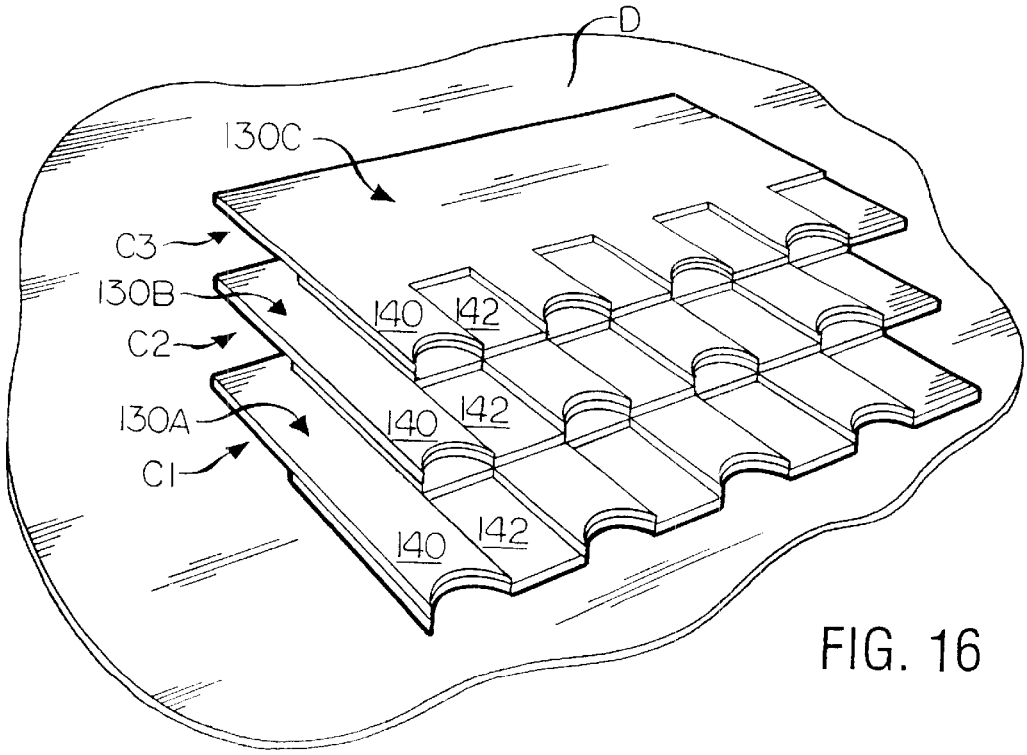
FIG. 16 is a perspective view of a portion of a roof deck covered with the shingles of FIG. 13.

Referring now to FIGS. 15 and 16, the identically shaped shingles in overlapping longitudinal courses (for example, C2 and C3) are longitudinally offset by a predetermined distance, ½ X, rather than the distance, X, as in the earlier preferred embodiments. This longitudinal offset serves to prevent the joint which is formed between each adjacent shingle in each course from corresponding to the joint between the shingles in the subsequent overlapping course, similar to the earlier preferred embodiments of the invention.

However, in this preferred embodiment, the distance, ½ X, is equal to exactly one eighth of the overall width, W, of each shingle 130A, 130B, and 130C, rather than one-fourth of the overall width, W, in the earlier preferred embodiments. The choice of this distance, ½ X, vertically offsets each tab 20 of the shingles 130A, 103B, and 103C with each tab 140 in shingle in the immediately previous adjacent course. Because each tab 140 and each cutout 22 are substantially identical in shape and dimension, the choice of the distance, ½ X, also vertically aligns each tab 140 of the shingles 130A, 103B, and 103C with each cutout 142 of the shingle in the immediately previous adjacent course. As a result, each tab 140 of the shingle 130B in the course C2 is vertically offset from each tab 140 in the shingle 130A in the course C1, and each tab 140 of the shingle 130B is vertically aligned with each cutout 142 in the shingle 140A.

This longitudinal offsetting of the shingles 130A, 130B, 130C a predetermined distance of ½ X provides for a different tile simulating aspect of the invention than the previous preferred embodiment of the invention. In particular, each tab 140 is vertically aligned with each cutout 142 in the immediately previous adjacent course, providing for an alternating pattern optical effect. This effect, in combination with each tab 140 in the immediately subsequent adjacent course being three times as thick as the vertically aligned cutout 142 in the immediately previous adjacent course, provides for a heightened shadowing effect, further enhancing the tile simulating aspect of the invention. Although this embodiment does not include darker shading areas, it should be realized that this preferred embodiment of the invention can also be practiced by providing dark shadow areas on the underlay and/or overlay members 132, 134 to provide a different tile simulating aspect of the invention. It will be apparent to those skilled in the art that the embodiments shown in FIGS. 9–16 may be modified to provide tapered tabs and cutouts in these embodiments in a manner similar to that provided in FIGS. 5–8, to provide the 3-dimensional effect described herein with respect to FIGS. 9–16.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A laminated shingle, comprising:

an overlay member having a front surface, a rear surface, an upper portion and a lower portion, the upper portion including a layer of granules on the front surface forming a first shading area, the lower portion including one or more tabs separated by cutouts, each tab having a tab width and each cutout having a cutout width, and an immediately adjacent tab width and cutout width having substantially the same magnitude, each tab extending from a lower boundary of the upper portion to an overlay lower edge, the overlay lower edge having a substantially curved contour, an upper edge of each cutout having a substantially straight contour; and an underlay member having a front surface, the front surface being fixedly attached to the rear surface of the overlay member, the underlay member including a layer of granules on the front surface forming a second shading area, the underlay member further including an underlay lower edge, a portion of the underlay lower edge having a substantially curved contour, wherein each tab of the overlay member covers the second shading area of the underlay member.

2. The laminated shingle according to claim 1, wherein the one or more tabs are tapered from the lower boundary of the upper portion to the overlay lower edge.

3. The laminated shingle according to claim 1, wherein the tabs of the overlay define an overlap portion, and wherein when the laminated shingles are laid in courses on a roof, when a subsequent shingle is positioned adjacent to the just previous shingle, the overlap portion of the subsequent shingle overlaps the right-most edge of the just previous shingle, thereby defining a tapered cutout.

4. The laminated shingle according to claim 1, wherein the lower edge of each tab has a negatively curved contour.

5. The laminated shingle according to claim 1, wherein the portion of the underlay lower edge of the underlay member has a negatively curved contour.

6. The laminated shingle according to claim 1 wherein the front surface of the underlay member includes a shading area extending in a substantially straight line, and having a width substantially corresponding to a width of the underlay member.

7. The laminated shingle according to claim 1, wherein the first and second shading areas comprise a different color or hue than a remainder of the front surface of the underlay and overlay.

8. The laminated shingle according to claim 7, wherein the first and second shading areas comprises a darker color or hue.

9. A composite, laminated shingle, comprising:

an overlay member having front and rear surfaces, the overlay member including a headlap portion and a butt portion, the headlap portion including a lower boundary portion of a substantially straight contour, the butt portion including a plurality of tabs separated by cutouts, each tab having a tab width and each cutout having a cutout width, and an immediately adjacent tab width and cutout width having substantially the same magnitude, each tab extending in length from the lower boundary of the headlap portion to a lower edge defining a butt edge of the shingle, the lower edge of each tab having a substantially curved contour; and an underlay member having a front surface fixedly attached to the rear surface of the overlay member, the underlay member including an underlay lower edge, a portion of the underlay lower edge having a substantially curved contour corresponding to the lower edge of each tab and exposed portions extending between the tabs of the overlay member in the cutouts that separate the tabs, a lower edge of the exposed portions defining a portion of the butt edge of the shingle having a substantially straight contour, wherein the shingle operates to optically simulate the three dimensional ridges and valleys of a tiled roof when laid on a roof with other substantially identically shaped shingles in overlapping longitudinal courses in a predetermined assembly in which the tabs and cutouts of the substantially identically shaped shingles in each course are vertically aligned with the respective tabs and cutouts of the shingles in the next lower course of shingles, wherein the portion of the butt edge of the shingle defined by the lower edge of each tab of the overlay member and the portion of the lower edge of the underlay member has a negatively curved contour, and the underlay member further including a layer of granules on the front surface forming a shading area, the exposed portions of the underlay member exposing at least a portion of the shading area.

10. The laminated shingle according to claim 9, wherein the shading area comprises a different color or hue than a remainder of the front surface.

11. The laminated shingle according to claim 9, wherein the shading area comprises a darker color or hue.

12. A roof covering including a plurality of successive generally horizontal courses of laminated shingles, the shingles in each course being laid in a side-by-side relationship and horizontally offset from the shingles in adjacent courses, each laminated shingle comprising:

an overlay member having front and rear surfaces, the overlay member including a headlap portion and a butt portion, the headlap portion including a lower boundary portion of a substantially straight contour, the butt portion including a plurality of tabs separated by cutouts, each tab having a tab width and each cutout having a cutout width, and an immediately adjacent tab width and cutout width having substantially the same magnitude, each tab extending in length from the lower boundary of the headlap portion to an overlay lower edge defining a butt edge of the shingle, the lower edge of each tab having a substantially curved contour; and an underlay member having a front surface fixedly attached to the rear surface of the overlay member, the underlay including an underlay lower edge, the underlay member including a layer of granules on the front surface forming a first shading area, a portion of the underlay lower edge having a substantially curved contour corresponding to the lower edge of each tab and exposed portions extending between the tabs of said overlay member in the cutouts that separate the tabs to expose at least a portion of the first shading area, a lower edge of the exposed portions defining a portion of the butt edge of the shingle having a substantially straight contour, wherein the shingle operates to optically simulate the three dimensional ridges and valleys of a tiled roof when laid on a roof with other substantially identically shaped shingles in overlapping longitudinal courses in a predetermined assembly in which one of the tabs and cutouts of the identically shaped shingles in each course are vertically aligned with each other.

13. The roof covering according to claim 12, wherein the headlap portion of the overlay member includes a layer of granules on the front surface forming a second shading area.

14. The roof covering according to claim 12, wherein the shingles in overlapping longitudinal courses are longitudinally offset from the next lower course of shingles by a distance that is approximately one-fourth of the width of the shingles.

15. The laminated shingle according to claim 13, wherein the first and second shading areas comprise a different color or hue than a remainder of the front surface of the underlay and overlay.

16. The laminated shingle according to claim 15, wherein the first and second shading areas comprises a darker color or hue.

17. A laminated shingle, comprising:

an overlay member having a front surface, a rear surface, an upper portion and a lower portion, the lower portion including one or more tabs separated by cutouts, each tab having a tab width and each cutout having a cutout width, and an immediately adjacent tab width and cutout width having substantially the same magnitude, each tab extending from a lower boundary of the upper portion to an overlay lower edge, the lower edge of each tab having a substantially curved contour, an upper edge of each cutout having a substantially straight contour; and an underlay member having a front surface, the front surface being fixedly attached to the rear surface of the overlay member, the underlay member further including an underlay lower edge, a portion of the underlay lower edge having a contour corresponding to the contour of the curved lower edge of each tab, the curved lower edge of each tab aligned with the curved portion of the underlay lower edge; wherein the front surface of the overlay member includes an overlay shading area extending in a substantially straight line along the lower boundary of the upper portion of the overlay member, the overlay shading area having a width substantially corresponding to a width of the overlay member; and wherein each tab of the laminated shingle is positioned overlapping the overlay shading area of a laminated shingle in a next lower course of shingles, the aligned curved lower edge of each tab and curved portion of the underlay lower edge thereby defining a curved shaped exposed portion of the shading area on the next lower course of shingles.

18. The laminated shingle according to claim 17, wherein the overlay shading area comprises a different color or hue than a remainder of the front surface of the overlay.

19. The laminated shingle according to claim 18, wherein the shading area comprises a darker color or hue.

* * * * *